US010301911B2

(12) United States Patent
Scott et al.

(10) Patent No.: US 10,301,911 B2
(45) Date of Patent: May 28, 2019

(54) APPARATUS FOR ENGAGING AND RELEASING AN ACTUATOR OF A MULTIPLE ACTUATOR SYSTEM

(71) Applicant: Halliburton Energy Services, Inc., Houston, TX (US)

(72) Inventors: Bruce E. Scott, McKinney, TX (US); James D. Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/836,082

(22) Filed: Dec. 8, 2017

(65) Prior Publication Data

US 2018/0100376 A1 Apr. 12, 2018

Related U.S. Application Data

(62) Division of application No. 14/890,493, filed as application No. PCT/US2013/075987 on Dec. 18, 2013, now Pat. No. 9,874,073.

(51) Int. Cl.

| | |
|---|---|
| ***E21B 34/14*** | (2006.01) |
| ***E21B 34/06*** | (2006.01) |
| *E21B 34/00* | (2006.01) |

(52) U.S. Cl.

CPC ..... *E21B 34/14* (2013.01); *E21B 34/066* (2013.01); *E21B 2034/005* (2013.01)

(58) Field of Classification Search

CPC combination set(s) only.

See application file for complete search history.

(56) References Cited

U.S. PATENT DOCUMENTS

| | | | |
|---|---|---|---|
| 4,161,215 | A | 7/1979 | Bourne, Jr. et al. |
| 4,577,694 | A | 3/1986 | Brakhage, Jr. |
| 5,309,988 | A | 5/1994 | Shy et al. |
| 5,358,035 | A | 10/1994 | Grudzinski |

(Continued)

OTHER PUBLICATIONS

International Search Report and Written Opinion issued in related PCT Application No. PCT/US2013/075987, dated Sep. 22, 2014 (10 pages).

(Continued)

*Primary Examiner* — D. Andrews

*Assistant Examiner* — Ronald R Runyan

(74) *Attorney, Agent, or Firm* — Scott Richardson; Baker Botts L.L.P.

(57) ABSTRACT

Apparatuses for engaging an actuator of a subsurface tool are disclosed, comprising: a valve closure device; a plurality of actuation assemblies, comprising: an actuation device; an actuation rod, wherein the actuation device is configured to axially translate the actuation rod; an actuation platform, wherein the actuation rod engages the actuation platform; a plurality of actuation heads, configured to engage the actuation platform; and wherein the plurality of actuation heads engage an actuation member and are configured to transfer mechanical force to the actuation member, thereby axially translating the actuation member; and wherein axial translation of the actuation member exerts a downward force on the valve closure device to move the valve closure device from a closed position to an open position.

7 Claims, 13 Drawing Sheets

(56) References Cited

U.S. PATENT DOCUMENTS

| | | | | |
|---|---|---|---|---|
| 5,456,313 | A * | 10/1995 | Hopper | E21B 33/0355 166/368 |
| 6,433,991 | B1 | 8/2002 | Deaton et al. | |
| 6,619,388 | B2 | 9/2003 | Dietz et al. | |
| 8,002,042 | B2 | 8/2011 | Going, III | |
| 2005/0061519 | A1 | 3/2005 | Wagner et al. | |
| 2009/0050327 | A1 | 2/2009 | Anderson et al. | |
| 2013/0092396 | A1 | 4/2013 | Webber et al. | |
| 2013/0248203 | A1 | 9/2013 | Scott et al. | |

OTHER PUBLICATIONS

International Preliminary Report on Patentability issued in related PCT Application No. PCT/US2013/075987, dated Jun. 30, 2016, 7 pages.

* cited by examiner

APPARATUS FOR ENGAGING AND RELEASING AN ACTUATOR OF A MULTIPLE ACTUATOR SYSTEM

CROSS-REFERENCE TO RELATED APPLICATION

The present application is a divisional application of U.S. patent application Ser. No. 14/890,493 filed Nov. 11, 2015 which is a U.S. National Stage Application of International Application No. PCT/US2013/075987 filed Dec. 18, 2013, both of which are incorporated herein by reference in their entirety for all purposes.

BACKGROUND

The present disclosure relates generally to operations performed and equipment utilized in conjunction with a subterranean well and, in particular, to safety valves having redundant operators or systems.

Subsurface safety valves are well known in the oil and gas industry and act as a failsafe to prevent the uncontrolled release of reservoir fluids in the event of a worst-case-scenario disaster. Typical subsurface safety valves are flapper-type valves that are opened and closed with the help of a flow tube moving telescopically within the associated production tubular. The flow tube is often controlled hydraulically from the surface and is forced into its open position using a piston and rod assembly that may be hydraulically charged via a control line linked to a hydraulic manifold or control panel at the well surface. When sufficient hydraulic pressure is conveyed to the subsurface safety valve via the control line, the piston and rod assembly forces the flow tube downward, which causes the flapper to move downward to the open position. When the hydraulic pressure is removed from the control line, the flapper can move into its closed position.

Some safety valves are arranged thousands of feet underground and are therefore required to traverse thousands of feet of production tubulars, including any turns and/or twists formed therein. Consequently, during its descent downhole, the control line for an associated safety valve may undergo a substantial amount of vibration or otherwise sustain significant damage thereto. In extreme cases, the control line may be severed or one of the connection points for the control line may become inadvertently detached and/or damaged either at a surface well head or at the safety valve itself, thereby rendering the safety valve potentially powerless and inoperable. Moreover, during prolonged operation in downhole environments that exhibit extreme pressures and/or temperatures, the hydraulic actuating mechanisms used to move the flow tube may fail due to mechanical failures such as seal wear and the like. As a result, some safety valves prematurely fail, thereby leading to a need for redundant safety valve operators or systems.

BRIEF DESCRIPTION OF THE DRAWINGS

Some specific exemplary embodiments of the disclosure may be understood by referring, in part, to the following description and the accompanying drawings.

Figure 1:
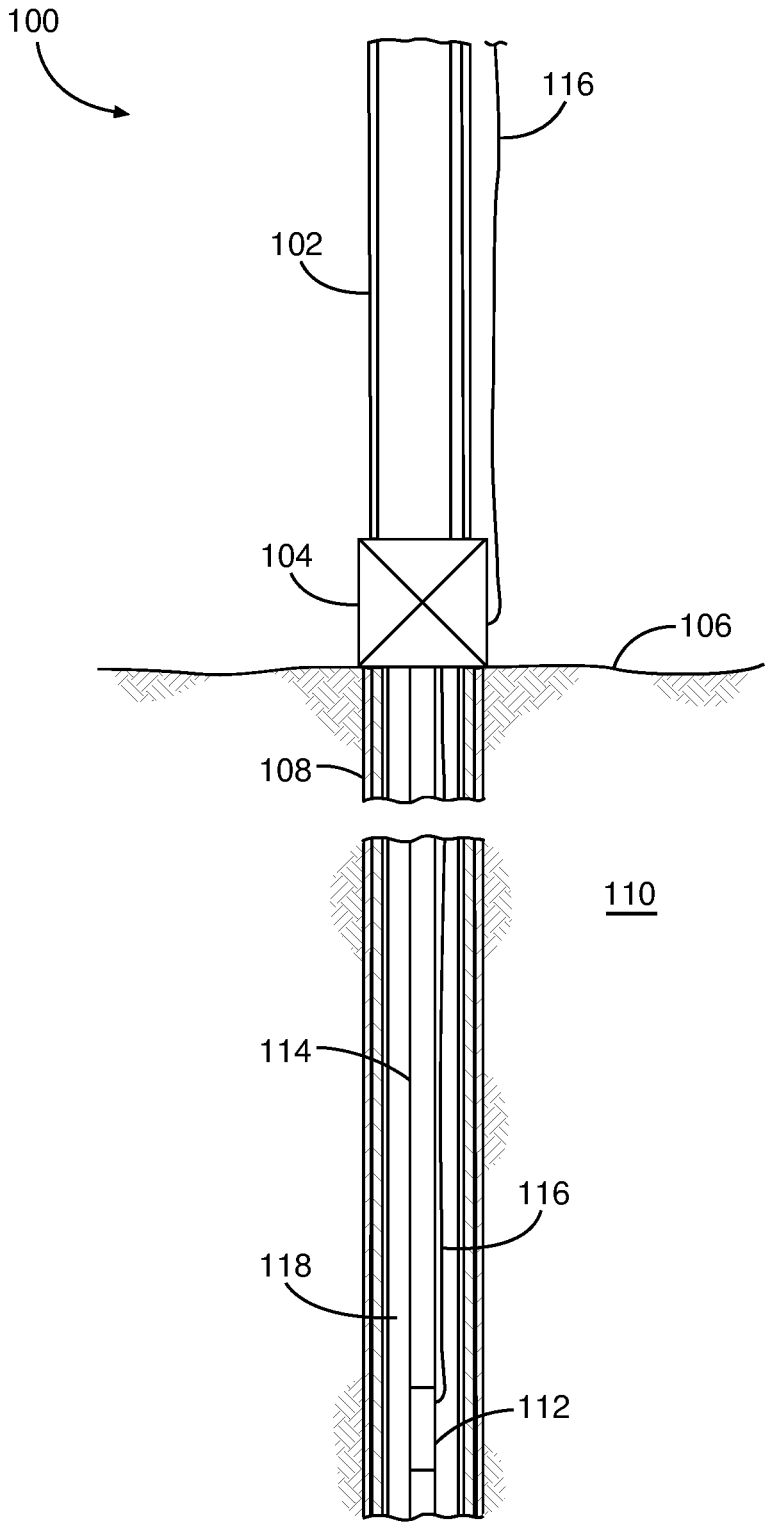
FIG. 1 illustrates an example well system that incorporates one or more principles of the present disclosure, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to operations performed and equipment utilized in conjunction with a subterranean well and, in particular, to safety valves having redundant operators or systems.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

The terms "couple" or "couples" as used herein are intended to mean either an indirect or direct connection. Thus, if a first device couples to a second device, that connection may be through a direct connection, or through an indirect mechanical or electrical connection via other devices and connections. The term "uphole" as used herein means along the drillstring or the hole from the distal end towards the surface, and "downhole" as used herein means along the drillstring or the hole from the surface towards the distal end.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

Referring to FIG. 1, illustrated is a well system 100 which incorporates one or more embodiments of an exemplary subsurface safety valve 112, according to the present disclosure. As illustrated, the well system 100 may include a riser 102 extending from a wellhead installation 104 arranged at a sea floor 106. The riser 102 may extend, for example, to an offshore oil and gas platform (not shown). A wellbore 108 extends downward from the wellhead installation 104 through various earth strata 110. The wellbore 108 is depicted as being cased, but it may be an uncased wellbore 108, without departing from the scope of the disclosure. Although FIG. 1 depicts the well system 100 in the context of an offshore oil and gas application, it will be appreciated by those skilled in the art that the various embodiments disclosed herein are equally well suited for use in or on other types of oil and gas rigs, such as land-based oil and gas rigs or rigs located at any other geographical site. Thus, it should be understood that the disclosure is not limited to any particular type of well.

The well system 100 may further include a subsurface safety valve 112 interconnected with a tubing string 114 arranged within the wellbore 108 and extending from the wellhead installation 104. The tubing string 114 may be able to communicate fluids derived from the wellbore 108 to the well surface via the wellhead installation 104. In some embodiments, a control line 116 may extend from the well surface and into the wellhead installation 104 which, in turn, conveys the control line 116 into an annulus 118 defined between the wellbore 108 and the tubing string 114. In certain embodiments, additional control lines may be added. The control line 116 may extend downward within the annulus 118 to be eventually communicably coupled to the subsurface safety valve 112. As discussed in more detail below, the control line 116 may be configured to actuate the subsurface safety valve 112, for example, to maintain the subsurface safety valve 112 in an open position, or otherwise to close the subsurface safety valve 112 and thereby prevent flow through the valve 112 and to the surface (e.g., a blowout in the event of an emergency).

In certain embodiments, the control line 116 may be electrical conduits that provide electricity to the subsurface safety valve 112. In operation, electrical power may be supplied to the subsurface safety valve 112 via the control line 116 from a remote location, such a production platform or subsea control station. The electrical power may allow the subsurface safety valve 112 to be opened and may maintain the subsurface safety valve 112 in its open position, thereby allowing production fluids to flow through the tubing string 114. To move the subsurface safety valve 112 from its open position into a closed position, the electrical power supplied by the control line 116 may be reduced or otherwise eliminated.

While only one control line 116 is depicted in FIG. 1, it should be understood that more than one control line 116 may be employed, without departing from the scope of the disclosure. In other examples, the control line 116 could include hydraulic lines and/or optical lines or other types of lines, instead of or in addition to electrical lines. Thus, the control line 116 could include any type, number and combination of lines in keeping with the scope of this disclosure. Moreover, although the control line 116 is depicted in FIG. 1 as being arranged external to the tubing string 114, it will be readily appreciated by those skilled in the art that the control line 116 may be internal to the tubing string 114, or formed in a sidewall of the tubing string 114. The control line 116 could extend from a remote location, such as from the earth's surface, or another location in the wellbore 108.

Figure 2A:
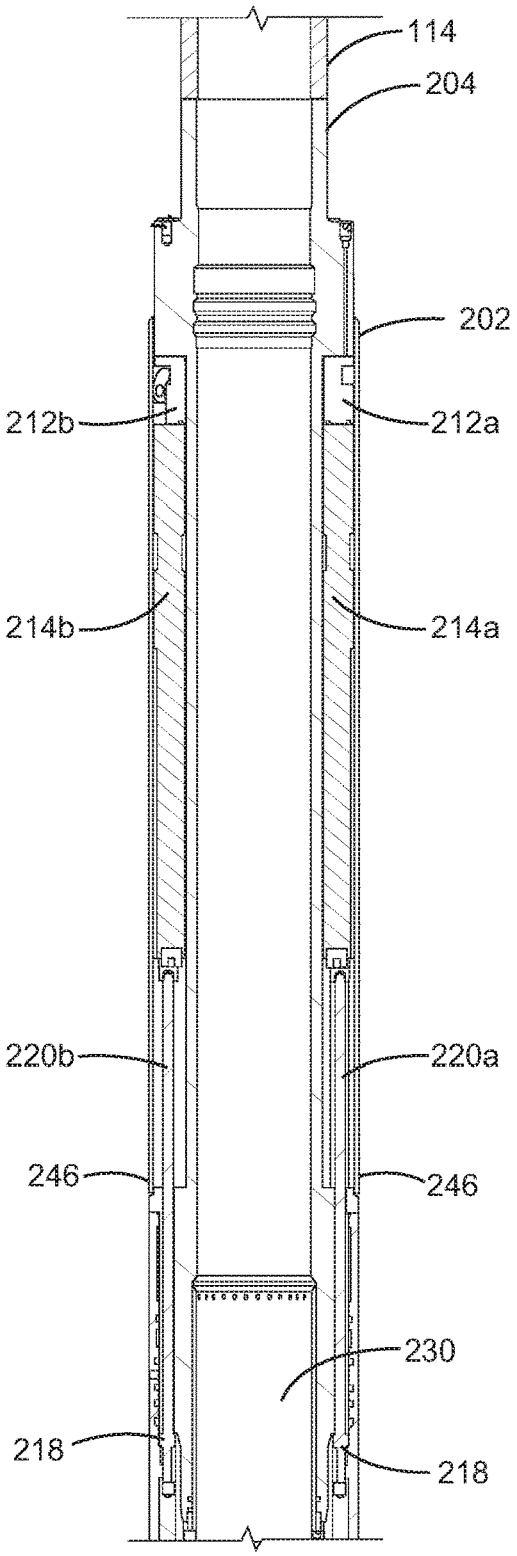
FIG. 2A shows a cross-section of the upper portion of an example safety valve system, according to aspects of the present disclosure.
Figure 2B:
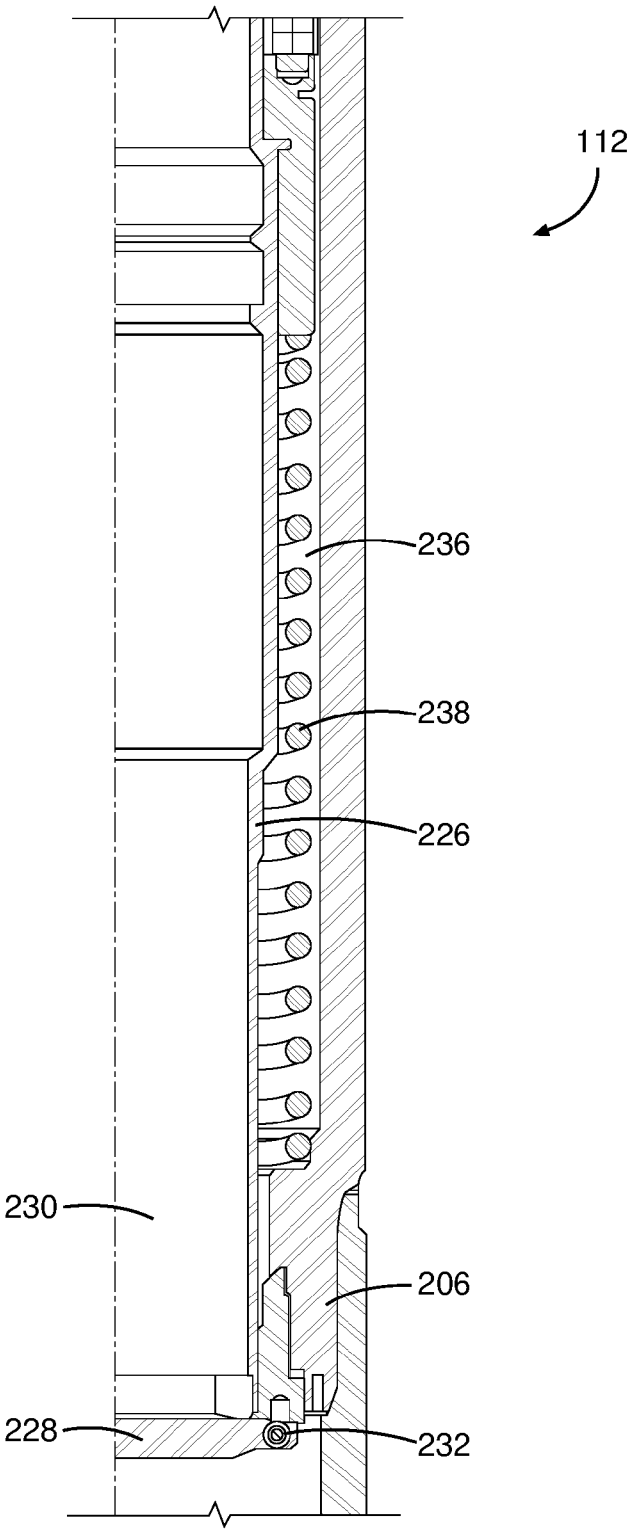
FIG. 2B shows a cross-section of the lower portion of an example safety valve system, according to aspects of the present disclosure.

Referring now to FIGS. 2A and 2B, illustrated is an exemplary embodiment of the subsurface safety valve 112, according to aspects of the present disclosure. In particular, the subsurface safety valve 112 is depicted in FIGS. 2A and 2B in successive sectional views, where FIG. 2A depicts an upper portion of the subsurface safety valve 112 and FIG. 2B depicts a lower portion of the subsurface safety valve 112. As illustrated, the subsurface safety valve 112 may have a housing 202 that includes an upper connector 204 (FIG. 2A) and a lower connector 206 (FIG. 2B) for interconnecting the subsurface safety valve 112 with the tubing string 114.

A control line port 208*a* may be defined in the housing 202 or otherwise provided for connecting the control line 116 (FIG. 1) to the subsurface safety valve 112. In certain embodiments, a second control line port 208*b* may be defined in the housing 202. An actuator bore 212 may be an elongate channel defined within the housing 202 and configured to extend longitudinally along a large portion of the subsurface safety valve 112. A first actuation device 214*a* may be arranged within the actuator bore 212*a* and configured to extend an actuation rod (not shown) axially therein. The subsurface safety valve 112 may further include a second actuation device 214*b* arranged within the actuator bore 212*b* and radially spaced from the first actuation device 214*a*. Similar to the first actuation device 214*a*, the second actuation device 214*b* may also be configured to extend an actuation rod (not shown) axially within the actuator bore 212. Other embodiments may further include additional actuation devices in keeping with the principles of the disclosure, including, but not limited to, linear electric actuators using ball screws, roller screws, lead screws, and/or rack and pinion devices to extend the actuation rod. Further, other embodiments may include actuation devices comprising a electrically driven hydraulic pump, which may be housed in the top sub or a nearby sub.

The subsurface safety valve 112 may include a valve closure device 228 that selectively opens and closes a flow passage 230 extending axially through the subsurface safety valve 112. As illustrated in FIG. 2B, the valve closure device 228 may be a flapper. It should be noted that, although the subsurface safety valve 112 is depicted as being a flapper-type safety valve, those skilled in the art will readily appreciate that any type of safety valve may be employed, without departing from the scope of the disclosure. For example, in some embodiments, the subsurface safety valve 112 could instead be a ball-type safety valve, or a sleeve-type safety valve, etc.

As shown in FIG. 2B, the valve closure device 228 is shown in its closed position, and a torsion spring 232 biases the valve closure device 228 to pivot to its closed position. A flow tube 226 may be used to overcome the spring force of the torsion spring 232 and thereby displace the valve closure device 228 between its open and closed positions. For example, when the flow tube 226 is extended to its downward position, it engages and forces the valve closure device 228 into its open position. On the other had, upward displacement of the flow tube 226 will free the flow tube 226 from contact with the valve closure device 228 and permit the torsion spring 232 to pivot the valve closure device 228 back to its closed position. Accordingly, axial movement of one or more actuation members 220*a* and 220*b* within the actuator bore 212*a* and 212*b* will force the flow tube 226 to correspondingly move axially within the flow passage 230, and either open the valve closure device 228 or allow it to close, depending on its relative position.

The subsurface safety valve 112 may further define a lower chamber 236 within the housing 202. In certain embodiments, the lower chamber 236 may form part of the actuator bore 212, such as being an elongate extension thereof. A valve power spring 238 may be arranged within the lower chamber 236 and may be configured to bias the actuation member 220 upwardly, which, in turn, biases the actuator rod 216. Accordingly, expansion of the valve power spring 238 will cause the actuation rod 216 to move upwardly within the actuator bore 212.

It should be noted that while the valve power spring 238 is depicted as a coiled compression spring, it will be appreciated that any type of biasing device may be used instead of, or in addition to, the spring 238, without departing from the scope of the disclosure. For example, a wave spring, a disc spring (also known as a Belleville spring), a compressed gas, such as nitrogen, with appropriate seals may be used in place of the valve power spring 238. In other embodiments, the compressed gas may be contained in a separate chamber and tapped when needed.

Referring to FIG. 2A, the subsurface safety valve 112 may further include an up stop feature 218 arranged within the actuator bore 212. In some embodiments, the up stop feature 218 may be an integral feature of the actuator bore 212. The up stop feature 218 may be configured to engage the actuation member 220*a*, 220*b* as the actuation member 220 advances or is otherwise biased axially upwards within the actuator bore 212. As such, the up stop feature 218 may be configured to prevent the actuation member 220 from axially advancing past the up stop feature 218.

The subsurface safety valve 112 may optionally include a down stop feature 246. The down stop feature 246 may be configured to engage the actuation member 220 as the actuation member 220 advances axially downward within the actuator bore 212 to prevent the actuation member 220 from axially advancing past the down stop feature 246. The actuation device 214 may be configured to over-stroke the actuation member 220 past the down stop feature 246 as needed consistent with the present disclosure. Alternatively, the actuation device 214 may be configured to stroke closer to the down stop feature 246 as described by the present disclosure. In certain embodiments, the actuation device 214 may include a logical down stop. If the actuation device 214 includes a logical down stop, the actuation device 214 may also be configured to stroke past the logical down stop as described herein.

The subsurface safety valve 112 may be actuated in order to open and/or close the valve closure device 228 using the control line 116. For example, power may be provided to the actuation device 214 via the control line 116 and control line port 208*a* to extend the actuation rod (not shown) within the actuator bore 212. The actuation rod (not shown) may then engage and transfer mechanical force to the actuation member 220, thereby also causing the actuation member 220 to move axially downward within the actuation bore 212. Moving the actuation member 220 axially downward within the actuation bore 212 may simultaneously displace the flow tube 226 downward. As the flow tube 226 moves downward, it may engage and open the valve closure device 228 to permit production of well fluids through the flow passage 230. As the actuation member 220 moves axially downward within the actuator bore 212, the valve power spring 238 may be compressed within the lower chamber 236.

Upon reducing or removing the power provided via the control line 116 to the actuation device 214 and thereby reducing or removing the force placed on the actuation member 220 by the actuation rod (not shown), the upwardly biasing force of the valve power spring 238 may be configured to displace the actuation member 220 upwards in the actuator bore 212. In certain embodiments, the actuation member 220 may continue upward axial movement until the actuation member 220 engages the top stop feature 218 to prevent the actuation member 220 from further upward movement.

As the actuation member 220 moves axially upwards in response to the force of the valve power spring 238, the flow tube 226 may simultaneously move upwards and out of engagement with the valve closure device 228. Once free from engagement with the flow tube 226, the spring force of the torsion spring 232 may bias the valve closure device 228 back into its closed position.

Figure 3A:
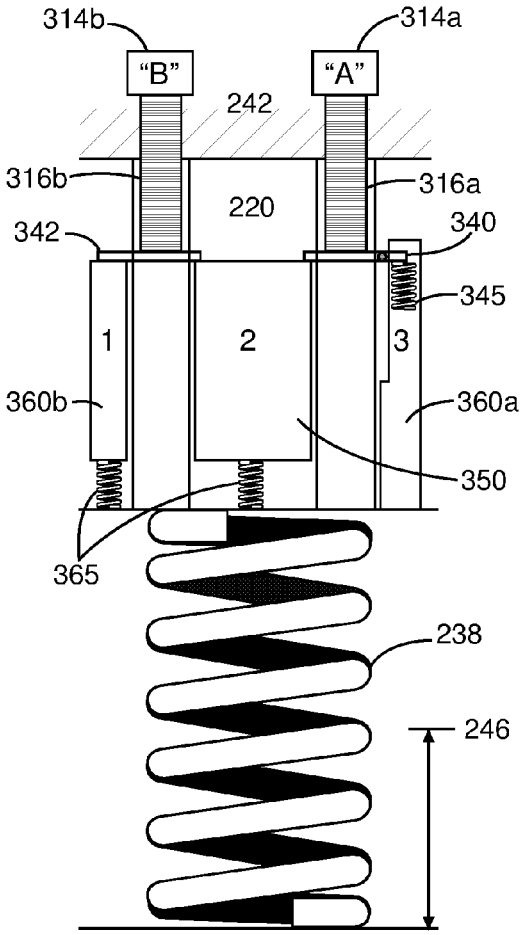
FIG. 3A illustrates a cross-sectional side view of an example safety valve system having primary and secondary actuators, according to aspects of the present disclosure.
Figure 3B:
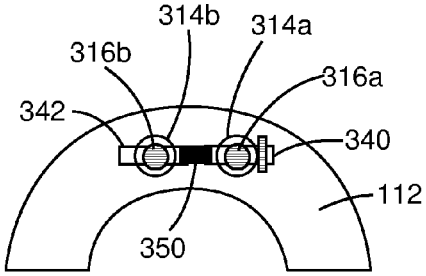
FIG. 3B illustrates a cross-sectional top view of an example safety valve system having primary and secondary actuators, according to aspects of the present disclosure.
Figure 3C:
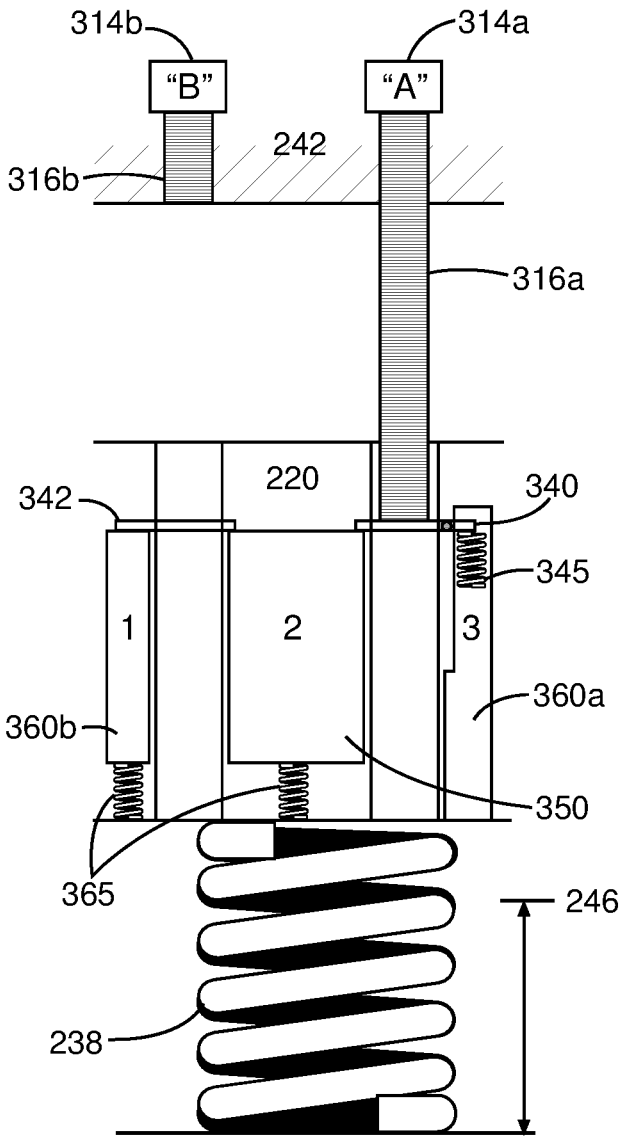
FIG. 3C illustrates a cross-sectional side view of an example safety valve system having primary and secondary actuators in an open state, according to aspects of the present disclosure.

Referring now to FIGS. 3A-3E, an exemplary embodiment of the subsurface safety valve 112 is shown. In one embodiment, the first actuation device may be a primary actuation device 314*a* and the second actuation device may be a secondary actuation device 314*b* radially spaced from the primary actuation device 314*a*. The primary actuation device 314*a* may be configured to extend a primary actuation rod 316*a* and the secondary actuation device 314*b* may be configured to extend a secondary actuation rod 316*b*. FIG. 3A shows a side-view and FIG. 3B shows a top-view of an exemplary embodiment of the subsurface safety valve 112 in the closed position with both the primary actuation rod 316*a* and the secondary actuation rod 316*b* in the respective closed positions. In one embodiment, the primary actuation device 314*a* may open the subsurface safety valve 112 by extending the primary actuation rod 316*a* to apply force against a primary actuator platform 340. The primary actuator platform 340 may be connected to a primary actuation head 360*a* and a shared actuation head 350, the primary actuation head 360*a* and shared actuation head 350 being connected to the actuation member 220. Accordingly, force exerted by the primary actuator rod 316*a* on the primary actuator platform 340, thereby forces the primary actuation head 360*a* and shared actuation head 350 to move the actuation member 220 downward. As described above, as the actuation member 220 moves down, the flow tube 226 also moves down and causes the valve closure device 228 to open. FIG. 3C shows an exemplary embodiment of the subsurface safety valve 112 in the normal open position with the primary actuation rod 316*a* extended and the secondary actuation rod 316*b* remaining in the closed position.

Figure 3D:
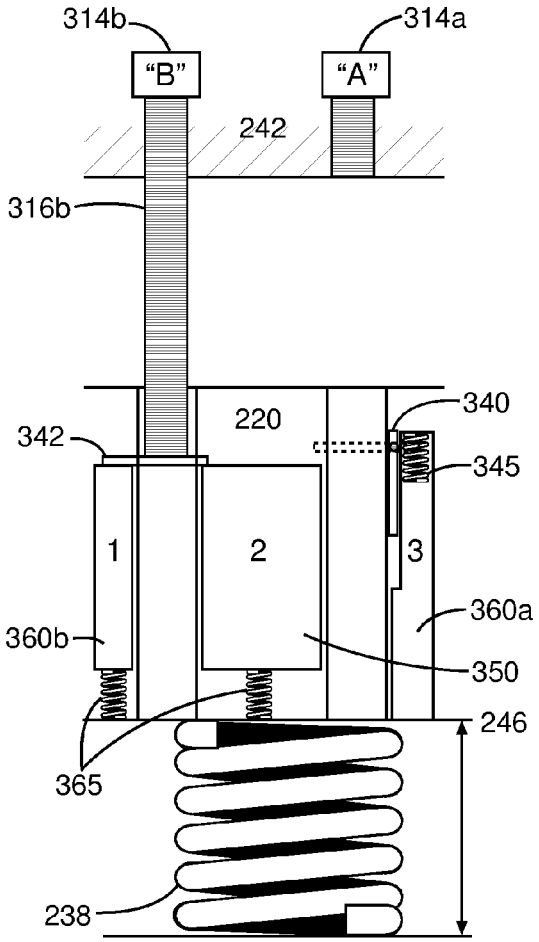
FIG. 3D illustrates a cross-sectional side view of an example safety valve system having primary and secondary actuators in an open state with a failed primary actuator, according to aspects of the present disclosure.
Figure 3E:
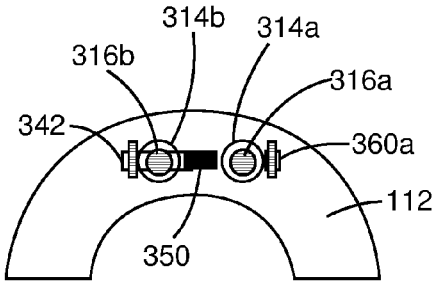
FIG. 3E illustrates a cross-sectional top view of an example safety valve system having primary and secondary actuators in an open state with a failed primary actuator, according to aspects of the present disclosure.

As shown by example in FIG. 3C, during normal operation the primary actuation device 314*a* may open and close the subsurface safety valve 112 while the secondary actuation device 314*b* remains in the closed position. If the primary actuation rod 316*a* becomes stuck in the extended position, preventing the valve closure device 228 from fully closing, the secondary actuation device 314*b* may be engaged to extend the secondary actuation rod 316*b*, as shown by example in FIGS. 3D and 3E. The secondary actuation device 314*b* may extend the secondary actuation rod 316*b* to full normal extension, operating against a secondary actuator platform 342 to move a secondary actuation head 360*b* and the shared actuator platform 350 downward. The primary actuator platform 340 may be biased to a retracted position (as shown in FIG. 3D), for example, by a platform retraction spring 345. As a result, the secondary actuation device 314*b* may over stroke the secondary actuation rod 316*b* past the open position, where the actuation member 220 may be engaged with the down stop feature 246 as described above, to compress at least one actuator head spring 365 and move the shared actuator head 350 downward relative to the actuator member 220. As a result, the shared actuator head 350 may be moved downward to allow the platform retraction spring 345 to move the primary actuator platform 340 into the retracted position. In the retracted position, the primary actuator platform 340 may not engage the primary actuation rod 316*a*, allowing the secondary actuation device 314*b* to normally operate the subsurface safety valve 112 without impediment from the primary actuation rod 316*a*. As such, the secondary actuation device 314*b* may operate against the secondary actuator platform 342, similar to the operation of the primary actuation device 314*a*, to move the actuation member 220 downward, causing the valve closure device 228 to open.

Figure 4A:
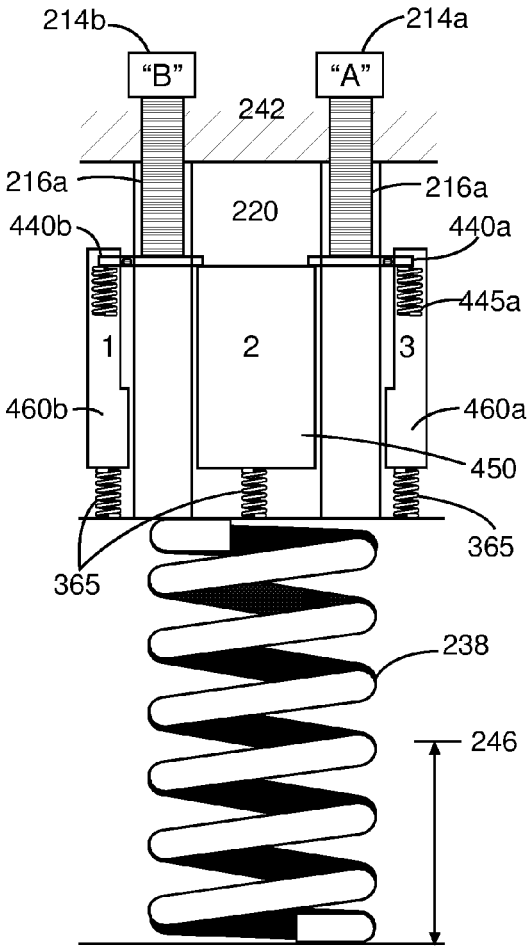
FIG. 4A illustrates a cross-sectional side view of an example safety valve system having two primary actuators, according to aspects of the present disclosure.
Figure 4B:
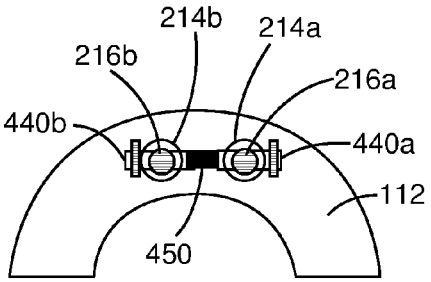
FIG. 4B illustrates a cross-sectional top view of an example safety valve system having two primary actuators, according to aspects of the present disclosure.
Figure 4C:
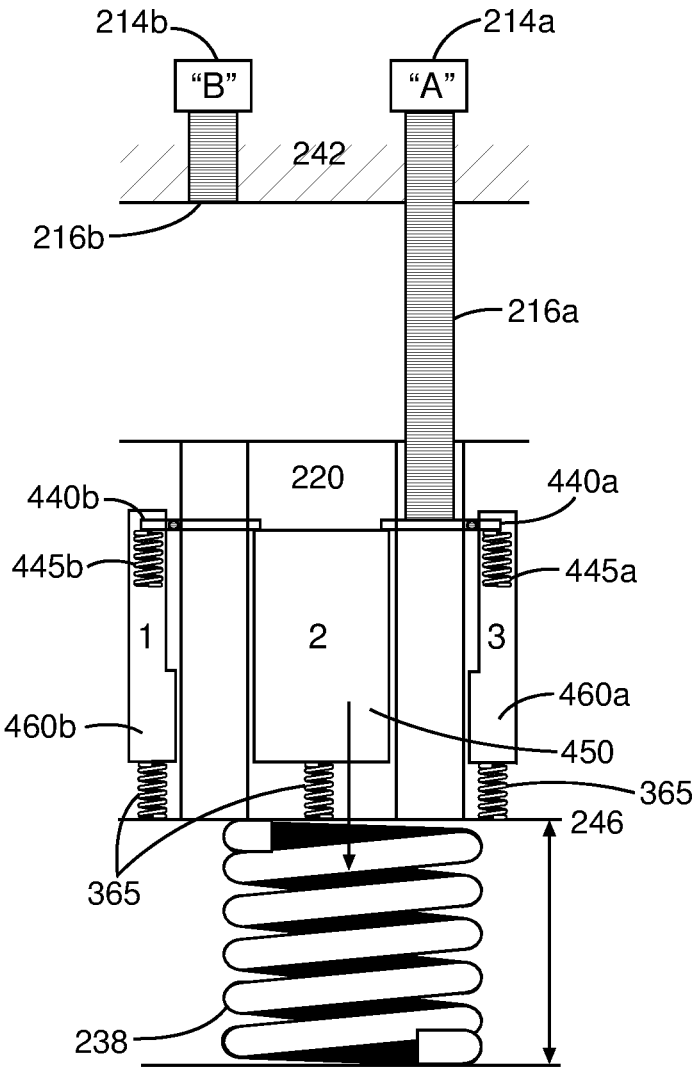
FIG. 4C illustrates a cross-sectional side view of an example safety valve system having two primary actuators in an open state, according to aspects of the present disclosure.
Figure 4D:
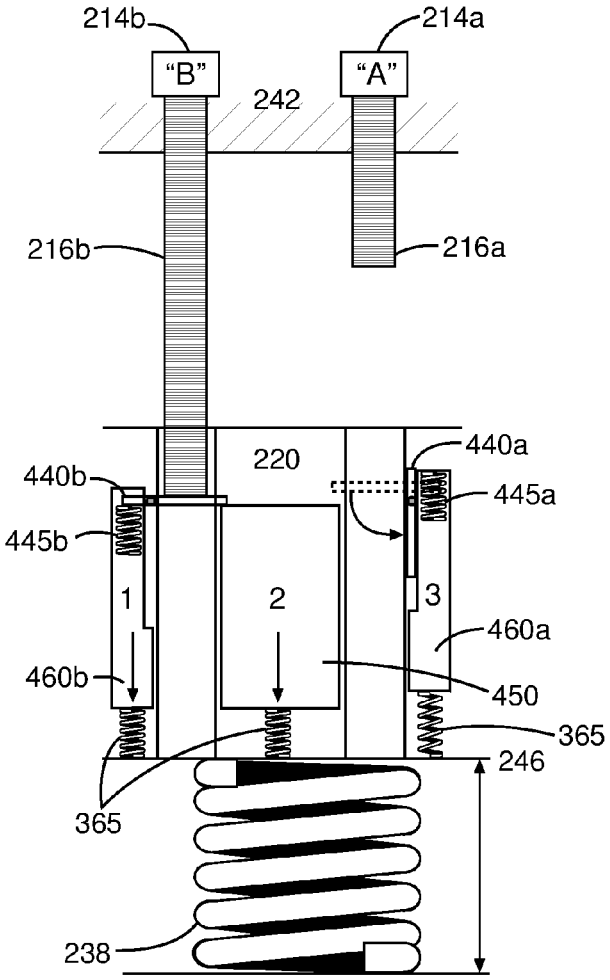
FIG. 4D illustrates a cross-sectional side view of an example safety valve system having two primary actuators in an open state with a failed actuator, according to aspects of the present disclosure.
Figure 4E:
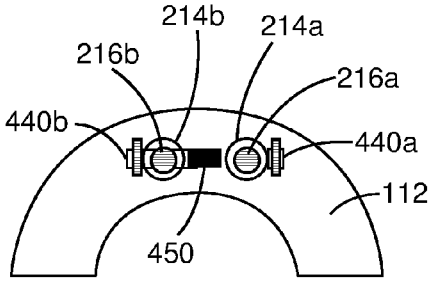
FIG. 4E illustrates a cross-sectional top view of an example safety valve system having two primary actuators in an open state with a failed actuator, according to aspects of the present disclosure.

Referring now to FIGS. 4A-4E, illustrated is an exemplary embodiment of the subsurface safety valve 112, according to one or more embodiments. As described above, in certain embodiments, the subsurface safety valve 112 may include a first actuation device 214*a* configured to extend a first actuation rod 216*b* and a second actuation device 214*b* configured to extend a second actuation rod 216*b*. The first actuation rod 214*a* may operate against a first actuation platform 440*a* and the second actuation rod 216*b* may operate against a second actuation platform 440*b*. Each actuation platform 440 may be configured to engage a shared actuation platform 450. During normal operation, the subsurface safety valve 112 may be opened or closed using either the first actuation device 214*a* or the second actuation device 214*b*. For example, FIG. 4C shows the first actuation device 214*a* moving the subsurface safety valve 112 into the open position. In certain embodiments, the first actuation device 214*a* and the second actuation device 214*b* may be used alternately to operate the subsurface safety valve 112. Similar to the process described in relation to FIGS. 3D and 3E, if the first actuation rod 216*a* becomes stuck in the extended position or otherwise fails, the second actuation device 214*b* may over stroke the second actuation rod 216*b* past the fully open position to an over stroked position, as shown by example in FIGS. 4D and 4E. In the over stroked position, the second actuation rod 216*b* may force a second actuation head 460*b* and a shared actuation head 450 downward relative to the actuation member 220, compressing the at least one actuator head spring 365. In certain embodiments, the at least one actuator head spring 365 may be configured to provide a resistance such that force applied by an actuation rod 216 to an actuation platform 440 will compress the valve power spring 238 and cause minimal compression of the at least one actuator head spring 365, unless the actuation member is over stroked against the down stop feature 246 by the actuation rod 216. As a result, extension of the first actuation rod 216*a* or the second actuation rod 216*b* may not cause the shared actuator head 450 to move downward relative to the actuation member until the actuation rod 216 is extended to an over stroke position. In the over stroked position, the shared actuation head 450 may be moved clear of the first actuation platform 440*a* to allow a first platform retraction spring 445*a* to move the first actuation platform 440*a* into a retracted position (as shown in FIG. 4D). In the retracted position, the first actuator platform 440*a* may not engage the first actuation rod 216*a*, allowing the second actuation device 214*b* to normally operate the subsurface safety valve 112 without impediment from the first actuation rod 216*a*. As such, the second actuation device 214*b* may operate against the second actuator platform 440*b* to move the actuation member 220 downward, causing the valve closure device 228 to open.

Similarly, if the second actuation rod 216*b* becomes stuck in the extended position or otherwise fails, the first actuation device 214*a* may over stroke the first actuation rod 216*a* past the fully open position to an over stroked position, causing the at least one actuator head spring 365 to compress. In the over stroked position, the shared actuation head 450 may be moved clear of the second actuation platform 440*b* to allow a second platform retraction spring 445*b* to move the second actuation platform 440*b* into the retracted position. In the retracted position, the second actuator platform 440*b* may not engage the second actuation rod 216*b*, allowing the first actuation device 214*a* to normally operate the subsurface safety valve 112 without impediment from the second actuation rod 216*b*. As such, the first actuation device 214*a* may operate against the first actuator platform 440*a* to move the actuation member 220 downward, causing the valve closure device 228 to open, as described above.

Referring now to FIGS. 5A-5F, illustrated is an exemplary embodiment of the subsurface safety valve 112, according to one or more embodiments. In certain embodiments, the subsurface safety valve 112 may include at least one actuation device 514 configured to extend at least one actuation rod 516. The at least one actuation rod 516 may be extended into an actuation rod passage 540 in the actuation member 220. In certain embodiments, the subsurface safety valve 112 may further include at least one key 520 attached to the actuation member 220 and at least one expander 530 attached to the actuation member 220. As shown by example in FIGS. 5A and 5B, the at least one key 520 may be biased to a retracted position by a key torsion spring 525 and the at least one expander 530 may be biased to a disengaged position by an expander spring 535. The at least one expander 530 may include a key head 532 configured to engage the corresponding key 520.

Figure 5A:
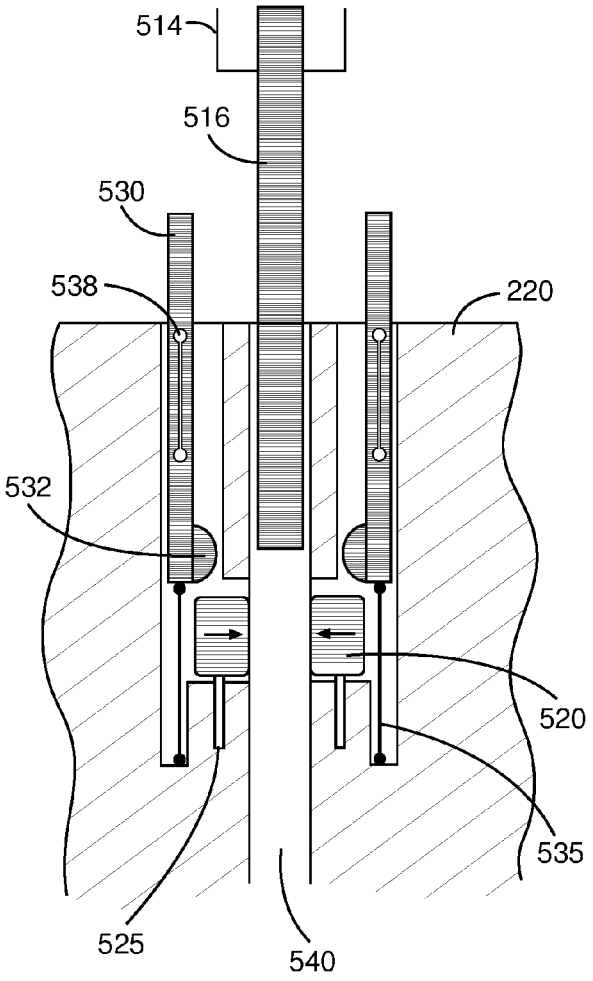
FIG. 5A illustrates a cross-sectional side view of an example safety valve system having resettable actuators in a neutral position, according to aspects of the present disclosure.
Figure 5B:
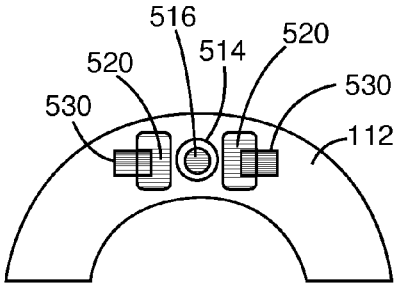
FIG. 5B illustrates a cross-sectional top view of an example safety valve system having resettable actuators in a neutral position, according to aspects of the present disclosure.
Figure 5C:
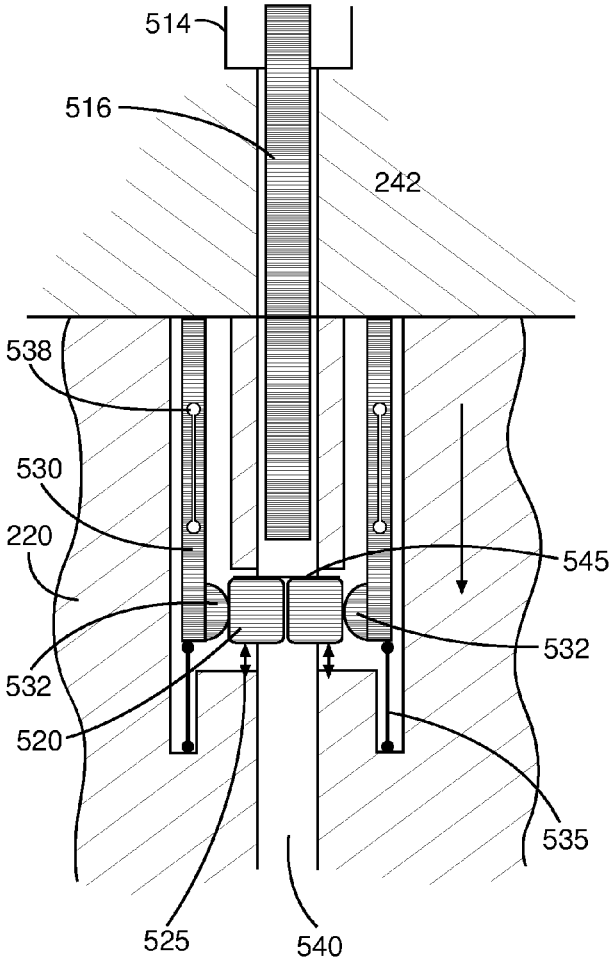
FIG. 5C illustrates a cross-sectional side view of an example safety valve system having resettable actuators in the up-closed position, according to aspects of the present disclosure.
Figure 5D:
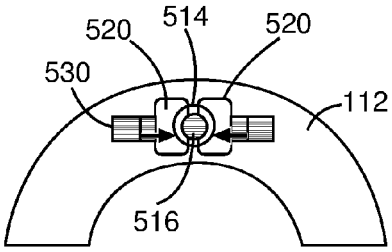
FIG. 5D illustrates a cross-sectional top view of an example safety valve system having resettable actuators in the up-closed position, according to aspects of the present disclosure.

Referring now to FIG. 5C, an exemplary embodiment is shown with the subsurface safety valve 112 in the up-closed position. An top stop feature 242 may engage the at least one expander 530 to push the at least one expander 530 into an engaged position, shown by example in FIGS. 5C and 5D. In the engaged position, the at least one expander 530 may push the corresponding at least one key 520 into a translated position with an expander key head 532, also shown by example in FIGS. 5C and 5D. In the translated position, the at least one key 520 may provide an actuation surface 545 for the at least one actuation rod 516 to operate against. With the at least one key 520 in the translated position, the actuation device 514 may extend the at least one actuation rod 516 to engage the at least one key 520 and force the actuation member 220 downward, opening the subsurface safety valve 112.

Figure 5E:
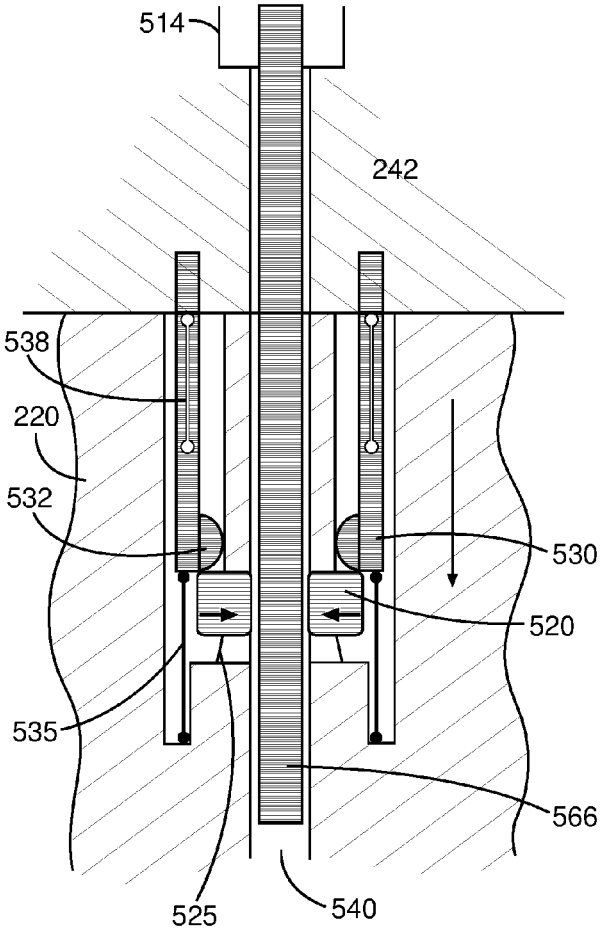
FIG. 5E illustrates a cross-sectional side view of an example safety valve system having resettable actuators in the up-closed position with a failed actuator rod, according to aspects of the present disclosure.
Figure 5F:
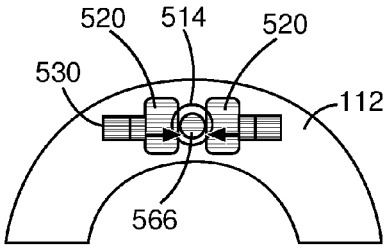
FIG. 5F illustrates a cross-sectional top view of an example safety valve system having resettable actuators in the up-closed position with a failed actuator rod, according to aspects of the present disclosure.

FIGS. 5E and 5F show an exemplary embodiment in the up-closed position with a failed actuation rod 566 in a stuck extended position. The at least one expander 530 may include a telescoping region 538. As such, the top stop feature 242 may push the at least one expander 530 into a compressed expander position when the at least one key 520 is prevented from moving to the translated position by the failed actuation rod 566. The at least one expander may include a telescoping region to allow the at least one expander to collapse, as shown by an example in FIGS. 5E and 5F. Until the failed actuator rod 566 is reset, the at least one key 520 may be prevented from moving into the translated position and may not create an actuator platform to engage the failed actuation rod 566. Accordingly, the subsurface safety valve 112 may be normally operated by another actuator rod 516 without impediment from the failed actuation rod 566. If the at least one actuator rod 516 is stuck temporarily, the at least one actuator rod 516 may be reset and reused in the subsurface safety valve 112.

Referring now to FIGS. 6A-6D, illustrated is an exemplary embodiment of an actuation system 610, according to one or more embodiments. The actuation system 610 may be comprised of an actuation device 614 and an actuation rod 616, wherein the actuation device 614 may be configured to extend an actuation rod 616 as described above.

The actuation rod 616 may include at least one retraction mechanism 620. The retraction mechanism 620 may comprise at least one of a lug, key, tab, dog, or any similar mechanism. The retraction mechanism 620 may be in an engaged position, as shown by example in FIGS. 6A and 6B, or in a disengaged position, as shown by example in FIGS. 6C and 6D. For example, the retraction mechanism 620 may comprise a solenoid operated device in which power extends the retraction mechanism 620 into the engaged position and removal of power causes the retraction mechanism 620 to retract into the disengaged position. The actuation member 220 may comprise a cavity 630 that is large enough to fit the actuation rod 616 when the retraction mechanism 620 is in the disengaged position. In the engaged position, the retraction mechanism 620 may engage the actuation member 220 to apply force against the actuation member 220 and cause the actuation member 220 to move downward. If the retraction mechanism 620 is in the disengaged position, the retraction mechanism 620 may be unable to engage the actuation member 220.

Figure 6A:
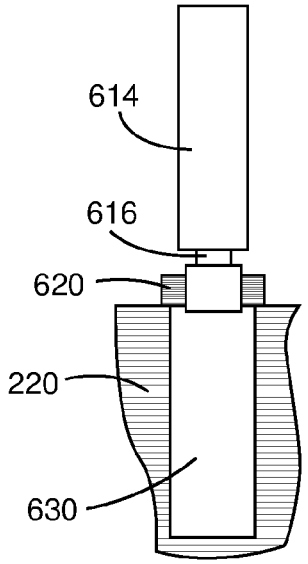
FIG. 6A illustrates a cross-sectional side view of an example safety valve system having an active secondary engaging mechanism with an actuator member in a retracted position, according to aspects of the present disclosure.
Figure 6B:
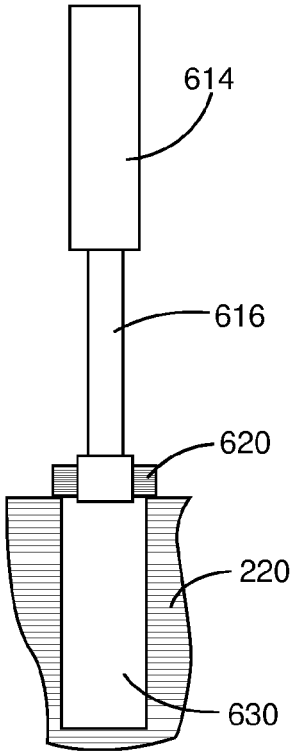
FIG. 6B illustrates a cross-sectional side view of an example safety valve system having an active secondary engaging mechanism with an actuator member in an extended position, according to aspects of the present disclosure.
Figure 6C:
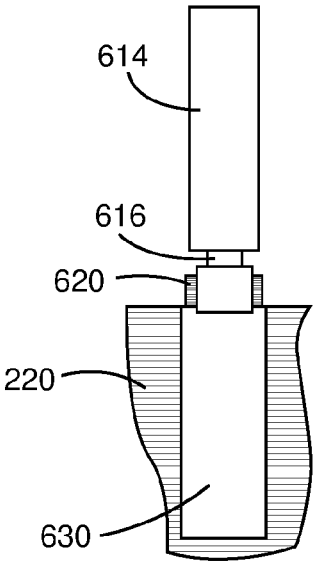
FIG. 6C illustrates a cross-sectional side view of an example safety valve system having an inactive secondary engaging mechanism with an actuator member in a retracted position, according to aspects of the present disclosure.
Figure 6D:
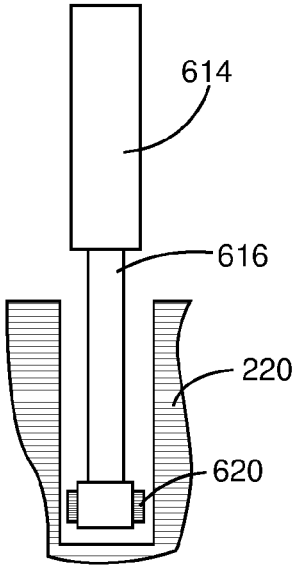
FIG. 6D illustrates a cross-sectional side view of an example safety valve system having an inactive secondary engaging mechanism with an actuator member in an extended position, according to aspects of the present disclosure.

FIGS. 6A and 6B show an embodiment of the actuation system 610 in an active and engaged state. FIG. 6A shows the actuation system 610 in the active but valve closed position. FIG. 6B shows the actuation system in the active and valve open position. Referring now to FIGS. 6C and 6D, an embodiment of the actuation system 610 is shown in the inactive state, where the retraction mechanism 620 is in the retracted position. FIG. 6C shows the actuation system 610 in the inactive state or failed state, where the retraction mechanism 620 is not engaging the actuation member 220. FIG. 6D shows an actuation system 610 in the failed and extended condition. The failed system is no longer powered so the retraction mechanism 620 is retracted to allow the subsurface safety valve 112 to function normally by use of another actuation system.

A plurality of actuation systems may be used. As a result, disengaging the retraction mechanism of a first actuation system may allow operation of the subsurface safety valve by a second actuation system, without interference from a disengaged actuation system, whether the disengaged actuation system is active, inactive, or in a failed state. The second actuation system may be located radially from the first actuation system.

In the case of a fault in the first actuation system causing the first actuation system to be stuck in a failed and extended condition, power may be removed from the failed actuation system and power may be supplied to the second actuation system to engage the retraction mechanism, and the second actuation system may be extended to stroke the actuation member away from engagement with the retraction mechanism of the first actuation system to allow the retraction mechanism to retract. This may be necessary if the retraction mechanism is unable to retract while engaging the actuation member. When the retraction mechanism is in the retracted state, the associated actuation system may be taken out of service and may not affect the ability to open or close the subsurface safety valve.

In certain embodiments, a method for engaging an actuator may comprise: providing a valve closure device having an open position and a closed position; providing a plurality of actuation assemblies, each comprising: an actuation device; an actuation rod, wherein the actuation device is configured to axially translate the actuation rod; an actuation platform, wherein the actuation rod engages the actuation platform; a plurality of actuation heads, configured to engages the actuation platform; and wherein the plurality of actuation heads engage an actuation member and are configured to transfer mechanical force to the actuation member, thereby axially translating the actuation member; and extending the actuation rod to axially translate the actuation member; and moving the valve closure device from a closed position to an open position.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. An apparatus for engaging an actuator of a subsurface tool, comprising:

a valve closure device;

a plurality of actuation assemblies, comprising:

a first actuation device of a first actuation assembly;

a first actuation rod of the first actuation assembly, wherein the first actuation device is configured to axially translate the first actuation rod;

a first retractable actuation platform of the first actuation assembly, wherein the first actuation device extends the first actuation rod to engage the first retractable actuation platform;

a first actuation head of the first actuation assembly, wherein the first actuation head engages the first retractable actuation platform, and wherein the first actuation head engages an actuation member and transfers mechanical force to the actuation member, thereby axially translating the actuation member;

a second actuation device of a second actuation assembly;

a second actuation rod of the second actuation assembly, wherein the second actuation device is configured to axially translate the first actuation rod;

a second retractable actuation platform of the second actuation assembly, wherein the second actuation device extends the second actuation rod to engage the second retractable actuation platform; and a second actuation head of the second actuation assembly, wherein the second actuation head engages the second retractable actuation platform, and wherein the second actuation head engages the actuation member and transfers mechanical force to the actuation member, thereby axially translating the actuation member;

wherein axial translation of the actuation member exerts a downward force on the valve closure device to move the valve closure device from a closed position to an open position;

wherein the first retractable actuation platform retracts when the second actuation device over strokes the second actuation rod past a fully open position to an over stroked position when the first actuation rod fails so as not to engage the first actuation rod with the first retractable actuation platform which allows the second actuation rod to operate against the second retractable actuation platform to control the valve closure device; and wherein second retractable actuation platform retracts when the first actuation device over strokes the first actuation rod past a fully open position to an over stroked position when the second actuation rod fails so as not to engage the second actuation rod with the second retractable actuation platform which allows the first actuation rod to operate against the first actuation platform to control the valve closure device.

2. The apparatus of claim 1, wherein at least one of the plurality of actuation assemblies is a releasing actuation assembly, further comprising:

an actuation platform retraction spring that biases a retractable actuation platform of the releasing actuation assembly to a retracted position, wherein the retractable actuation platform in the retracted position does not engage an actuation rod of the releasing actuation assembly.

3. The apparatus of claim 1, wherein the first actuation device comprises an actuator head spring, wherein the over stroke of the first actuation rod causes the actuator head spring to compress.

4. The apparatus of claim 1, further comprising a valve power spring engaging the actuation member to bias the actuation member upwardly.

5. The apparatus of claim 1, further comprising a down stop feature configured to engage the actuation member if the first actuation rod or the second actuation rod is extended past the open position.

6. The apparatus of claim 1, further comprising:

a flow tube having a conduit;

wherein the valve closure device forms a seal in the closed position and wherein the valve closure device allows the flow of fluid in the open position; and wherein the actuation member engages the flow tube and is configured to axially translate the flow tube and move the valve closure device to the open position.

7. The apparatus of claim 1, wherein at least one of the first actuation device and the second actuation device is electrically powered.

* * * * *